United States Patent [19]

Holoubek et al.

[11] Patent Number: 4,844,250

[45] Date of Patent: Jul. 4, 1989

[54] TAMPER-EVIDENT CONTAINER ASSEMBLY

[75] Inventors: George H. Holoubek; John J. Rhoades, both of Muscatine, Iowa

[73] Assignee: Wheeling Stamping Company, Wheeling, W. Va.

[21] Appl. No.: 287,575

[22] Filed: Dec. 15, 1988

Related U.S. Application Data

[63] Continuation of Ser. No. 121,284, Nov. 16, 1987, abandoned.

[51] Int. Cl.[4] ..... B65D 35/44

[52] U.S. Cl. ..... 222/107; 222/153; 215/318; 411/510; 411/908; 285/333

[58] Field of Search ..... 222/92, 107, 153; 215/32, 318, 329, 252; 411/510, 512, 394, 414, 907, 908; 285/333, 334

[56] References Cited

U.S. PATENT DOCUMENTS

| | | | |
|---|---|---|---|
| 578,338 | 3/1897 | Jenison . | |
| 1,968,747 | 9/1933 | Conlin | 215/7 |
| 2,045,388 | 6/1936 | Guthrie | 215/7 |
| 3,061,132 | 10/1962 | Geddes | 215/318 |
| 3,165,220 | 1/1965 | Haynes | 215/42 |
| 3,223,269 | 12/1965 | Williams | 215/318 |
| 3,731,849 | 5/1973 | Burrows | 222/153 |
| 4,298,129 | 11/1981 | Stuff | 215/318 |
| 4,435,111 | 3/1984 | Mizusawa | 411/512 |

*Primary Examiner*—H. Grant Skaggs
*Attorney, Agent, or Firm*—Parmelee, Miller, Welsh & Kratz

[57] ABSTRACT

A tamper-evident container assembly comprises a container and a cap. The container has a dispensing end that includes an opening through which the contents of the container can be dispensed, a threaded surface, and a frangible tab extending outwardly from the threaded surface. The cap is internally threaded with the threads of the cap being complementary to those of the threaded surface of the dispensing end of the container and being formed prior to the cap being placed on the dispensing end of the container. The cap has a vertical notch therein extending from the lower edge thereof of a size sufficient to receive at least a portion of the tab so that the tab is readily visible therethrough. The cap is initially placed axially over the dispensing end of the container so that the tab is received within the notch in the cap.

The cap can not be initially removed from the container without separating at least a portion of the tab from the threaded surface of the dispensing end of the container. The tab is separated from the threaded surface of the container by twisting the cap with respect to the container, so that the absence of the tab from the threaded surface of the dispensing end of the container indicates that the container has previously been opened.

13 Claims, 1 Drawing Sheet

TAMPER-EVIDENT CONTAINER ASSEMBLY

This is a continuation of co-pending application Ser. No. 121,284 filed on Nov. 16, 1987, and now abandoned.

BACKGROUND OF THE INVENTION

The invention relates to a tamper-evident container assembly and, more particularly, to such a tamper-evident container in which the closure is internally threaded, the threads of which are formed prior to the cap being placed on the dispensing end of the container.

Goods such as food, medicants and cosmetics are potentially dangerous to consumers if they have been contaminated before reaching the consumer. It is often difficult to determine by looking at the goods themselves whether the container has been opened prior to reaching the consumer because many goods themselves do not given an observable indication, such as a color change or odor, if they have been contaminated.

Thus, many producers of such goods package their goods in such a way that a consumer can readily examine a container and tell whether the contents of the container may have been tampered with after the container was packaged. Such packaging often involves a seal or other indicia, either associated with the cap or the container, that is broken or otherwise altered when the container is initially opened so that the seal or indicia can not be replaced or repaired in the same condition. Thus, when such a seal or indicia is in a condition different from its initial condition, the contents of the container should not be used because they could have been contaminated.

Various types of tamper-evident seals are available in the art. An advantageous feature of some of such seals is that the cap, or other sealing means, be reusable after initially being separated from the container, even in its altered condition.

U.S. Pat. Nos. 1,968,747, 2,045,388 and 3,165,220 disclose tamper-evident containers in which a tab extends outwardly from the threaded neck of the containers. The tabs must be separated from the containers before the closures can be removed to open the containers. Thus, the lack of a tab on the containers indicates that the containers have previously been opened. U.S. Pat. Nos. 1,968,747 and 2,045,388 require that the tabs be separated from the containers in a separate step. The tab in U.S. Pat. No. 3,165,220 can be separated from the container by twisting the closure with respect to the container as the closure is initially removed from the container. The closure are readily used to reseal the containers.

The closure of U.S. Pat. No. 3,165,220 includes lugs on its inner surface that correspond to the threads on the neck of the container and a notch corresponding to the tab or button. In order to initially secure the closure to the container, the closure is positioned on the container and axial pressure is exerted over the closure toward the container. The closure is slightly deformable to enable the lugs to pass over the threads of the container and snap back into place.

In order to form a tight seal with a container having a threaded neck, it is often desired to have a closure that includes an internally threaded surface, the threads of which are complementary to the threads of the neck of the container. A concern associated with the use of internally threaded closures on containers with a breakaway tab is the initial placement of the closure on the container without disturbing the tab. The internal threads of the closure of U.S. Pat. No. 2,045,388 are formed as the closure is placed over the neck of the container. The closure of U.S. Pat. No. 1,986,747 requires inner and outer cap members, neither of which interferes with the tab as it is placed on the container. The threaded inner cap member is required to form a tight seal and is not large enough to reach the tab. The outer cap member is not threaded and is placed over the inner cap member and cemented thereto to form a unitary closure. These closures are cumbersome and the process of placing them on the container involves several steps and is unduly complex.

Thus, it is desired to develop a tamperevident container in which the closure is internally threaded, the threads of which are formed prior to the cap being placed on the dispensing end of the container.

SUMMARY OF THE INVENTION

The present invention provides a tamperevident container assembly comprising a container and a cap. The container has a dispensing end that includes an opening through which the contents of the container can be dispensed, a threaded surface, and a frangible tab extending outwardly from the threaded surface. The cap is internally threaded with the threads of the cap being complementary to those of the threaded surface of the dispensing end of the container and being formed prior to the cap being placed on the dispensing end of the container. The cap has a vertical notch therein extending from the lower edge thereof of a size sufficient to receive at least a portion of the tab so that the tab is readily visible therethrough. The cap is initially placed axially over the dispensing end of the container so that the tab is received within the notch in the cap.

The cap can not be initially removed from the container without separating at least a portion of the tab from the threaded surface of the dispensing end of the container. The tab is separated from the threaded surface of the container by twisting or unscrewing the cap with respect to the container, so that the absence of the tab from the threaded surface of the dispensing end of the container indicates that the container has previously been opened.

Figure 1:
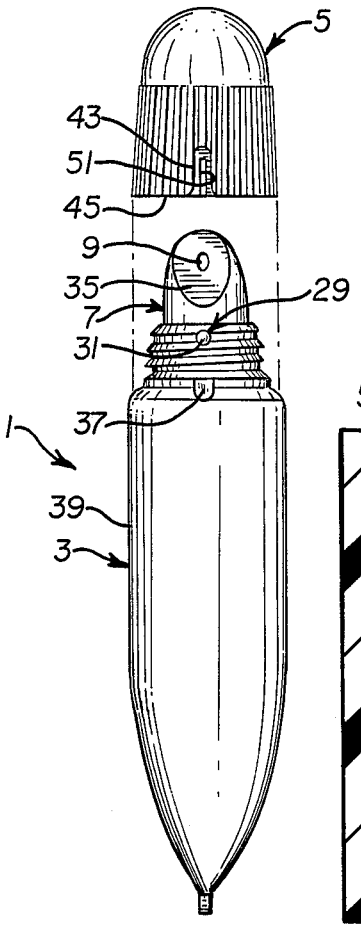
FIG. 1 is an exploded perspective front view of an embodiment of the tamper-evident container assembly of the present invention.

The container 3 includes a dispensing end 7 having an opening 9 therein through which the contents of the container 3 can be dispensed to the user. The dispensing end 7 of the container 3 further includes a threaded surface 11, the threads 13 of which are complementary to the threads 15 of the internally threaded surface 17 of the cap 5.

Figure 2:
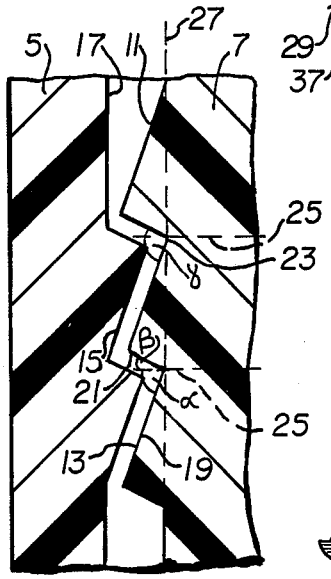
FIG. 2 is an exploded view of a section of the threaded surfaces of the cap and dispensing end of the container.
Figure 3:
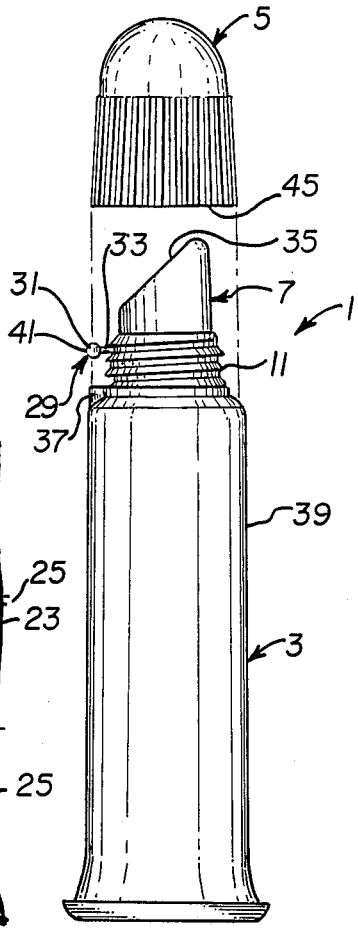
FIG. 3 is an exploded perspective side view of the tamper-evident container assembly of FIG. 1.

Preferably, as shown in FIG. 2, the threads 13 of the threaded surface 11 have a ratcheted configuration and include a downwardly and outwardly sloping leading edge 19 and an upwardly and outwardly sloping trailing edge 21, which meet at a root 23. The leading angle $\alpha$ is an acute angle of between about 55° and about 65° formed between the leading edge 19 and a line 25 through the root 23, which line 25 is perpendicular to the line 27 through all of the roots 23. The trailing angle $\beta$ is an acute angle of between about 5° and about 15° formed between the trailing edge 21 and the line 25 through the roots 23. More preferably, the leading angle $\alpha$ is about 60° and the trailing angle $\beta$ is about 10°. Thus, the ratchet angle $\gamma$ between the trailing edge 21 and the line 27 through the leading edge 19 is obtuse.

A frangible tab 29, the significance of which will be more fully explained later, extends outwardly from the threaded surface 11 of the dispensing end 7 of the container 3. Preferably, the tab 29 has an enlarged outer section 31, and a thin connecting section 33 connecting the enlarged outer section 31 to the threaded surface 11 of the dispensing end 7 of the container 3 so that the tab 29 can be easily separated from the container 3. More preferably, the outer section 31 is round.

The invention is particularly useful with collapsible or squeeze containers for viscous liquids that are cosmetics or medicants. The particular embodiment of tamper-evident container assembly 1 of the invention illustrated in the Figures is designed for a lip balm. Thus, the dispensing end 7 of the container 3 has an angled applicator surface 35, which includes the opening 9, so that the lip balm can easily be applied.

The container 3 is preferably formed of a thermoplastic material, such as polyethylene, extruded in a tubular shape. Initially, the container 3 is substantially cylindrical in shape and open at the bottom. Thus, the container 3 is filled from the bottom and then thermally sealed. The container 3 preferably includes a shoulder 37 to provide increased strength to the extrusion.

Figure 4:
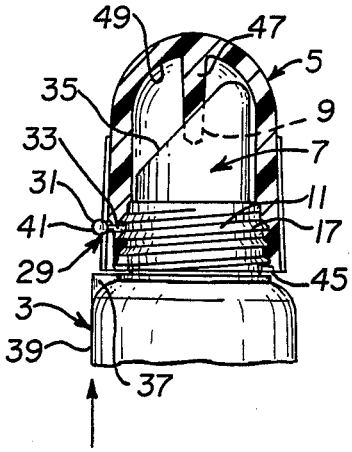
FIG. 4 is a view, partly in section, of the upper portion of the container of the tamper-evident container assembly of FIG. 2 showing the cap in place on the container.

Ink, or other printing medium, can be applied to the outer surface 39 of the container 3 to identify the contents of the container 3 through a logo or trademark, or to provide instructions for use of the contents thereof. Thus, preferably the outermost extending edge 41 of the enlarged outer section 31 of the tab 29 is coplanar with the outer surface 39 of the container 3, as indicated by the arrow in FIG. 4. In this way, ink can be applied to the edge 41 of the tab 29 at the same time as the rest of the outer surface 39 of the container 3 so that the tab 29 is readily visible to the consumer of the container assembly 1. In addition to the ability to apply an ink or other coloring medium to the edge 41 of the tab 29 at the same time as the printing of the outer surface 39 of the container 3 is effected, the arrangement enables the printing of the edge 41 of the outer section 31 of tab 29 in a distinctive color, such as red, simultaneously with printing of the container 3, to provide ready visibility of the existence or non-existence of the tab 29 to the purchaser or user of the tamper-evident collapsible container assembly 1.

The cap 5 includes an internally threaded surface 17, the threads 15 of which cooperate with those of the threaded surface 11 of the dispensing end 7 of the container 3 and are formed prior to the cap 5 being placed on the dispensing end 7 of the container 3. The threads 15 of the threaded surface 17 of the cap 5 can be of a standard configuration. However, as shown in FIG. 2, the threads 15 of the threaded surface 17 can be complementary to the ratcheted threads 13 of the threaded surface 11 of the dispensing end 7 of the container 3.

The cap 5 has a vertical notch 43 therein extending from the lower edge 45 thereof of a size sufficient to receive at least a portion of the tab 29 while the tab 29 is readily visible therethrough.

Figure 5:
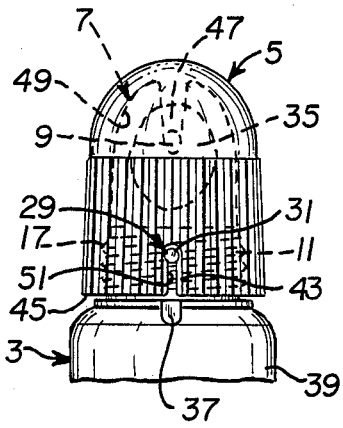
FIG. 5 is an elevational view of the upper portion of the container of the tamper-evident container assembly of FIG. 1 showing the cap in place on the container and the dispensing end of the container in dashed lines.
Figure 6:
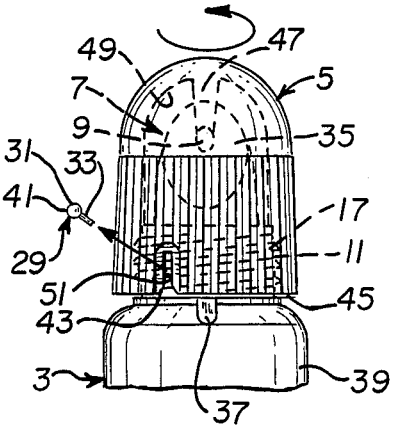
FIG. 6 is an elevational view of the upper portion of the container of the tamper-evident container assembly of FIG. 1, showing the cap in place on the container, the dispensing end of the container in dashed lines and the tab being broken away. cDETAILED DESCRIPTION OF THE PREFERRED EMBODIMENTS An embodiment of the tamper-evident container assembly 1 of the invention is illustrated, comprising a squeezable tube assembly, and includes a container 3 and a cap 5.

The cap 5 preferably includes a plug 47 (FIGS. 4, 5, and 6) extending from the inner surface 49 thereof, which is disposed within the opening 9 in the dispensing end 7 of the container 3 to seal the opening 9 when the cap 5 is in place of the dispensing end 7 of the container 3.

The cap 5 is initially placed axially over the threaded surface 11 of the dispensing end 7 of the container 3 so that the thin connecting section 33 of the tab 29 is received within the notch 43 in the cap 5. The leading edges 19 of the threads 13 of the threaded surface 11 of the dispensing end 7 of the container 3 act as ramps to allow the threads 15 of the threaded surface 17 of the cap 5 to slip over the threads 13 of the threaded surface 11 as the cap 5 is being placed on the dispensing end 7 of the container 3. However, the trailing edges of the threads 15 of the threaded surface 17 of the cap 5 can not slip over the trailing edges 21 of the threads 13 of the threaded surface 11 of the dispensing end 7 of the container 3 to remove the cap 5 from the container 3 because the ratchet angle $\gamma$ of the threads 13 of the threaded surface 11 of the dispensing end 7 of the container 3 is obtuse. Thus, the cap 5 can not be initially removed from the container 3 without separating the tab 29 from the threaded surface 11 of the dispensing end 7 of the container 3. The tab 29 is separated from the threaded surface 11 of the dispensing end 7 of the container 3 by twisting the cap 5 counterclockwise with respect to the container 3, as shown by the arrow in FIG. 6. The left edge 51 of the notch 43 contacts the thin connecting section 33 of the tab 29 and causes the readily visible enlarged outer section 31 of the tab 29 to break away from the dispensing end 7 of the container 3. Thus, the absence of the tab 29 from the threaded surface 11 of the dispensing end 7 of the container 3 indicates that the container 3 has previously been opened.

The cap 5 can readily be used to reseal the container 3. The interaction of the threaded surface 11 of the dispensing end 7 of the container 3 and the internally threaded surface 17 of the cap 5 provides a tight seal for the container 3, particularly because the ratchet angle $\gamma$ of the threads 13 of the threaded surface 11 of the dispensing end 7 of the container 3 is obtuse.

It will be readily understood by one of ordinary skill in the art that although the embodiment illustrated has only one tab 29 and notch 43 in connection with the tamper-evident container assembly 1 of the invention, the tamper-evident container assembly 1 can include a plurality of such tabs 29 and co-acting notches 43.

We claim:

1. A tamper-evident container assembly comprising:

a container having a dispensing end, said dispensing end including an opening through which the contents of said container can be dispensed, a threaded surface having a ratcheted configuration including a downwardly and outwardly sloping leading edge and an upwardly and outwardly sloping trailing edge, such that a threaded cap may be initially axially secured thereon but must be twisted for removal therefrom, and a frangible tab extending outwardly from said threaded surface; and an internally threaded cap, the threads of said cap being complementary to those of said threaded surface of said dispensing end of said container with their complementary leading edges inclined at an acute angle relative to downward axial movement of said cap over said dispenser end which angle is less than an acute angle defined by their complementary trailing edges relative to axial movement of said cap over said dispenser end for preventing upward axial movement of said cap, said threads of said cap being formed prior to said cap being placed on said dispensing end of said container, said cap having a vertical notch therein extending from the lower surface thereof of a size sufficient to receive at least a portion of said tab so that said tab is readily visible therethrough, said cap being initially placed axially over said dispensing end of said container so that said tab is received within said notch in said cap;

whereby said cap can not be initially removed from said container without separating at least a portion of said tab from said threaded surface of said dispensing end of said container, and said tab is separated from said threaded surface of said dispensing end of said container by twisting said cap with respect to said container, so that the absence of said tab from said threaded surface of said dispensing end of said container by twisting said cap with respect to said container, so that the absence of said tab from said threaded surface of said dispensing end of said container by twisting said cap with respect to said container, so that the absence of said tab from said threaded surface of said dispensing end of said container indicates that said container has previously been opened.

2. The tamper-evident container assembly of claim 1 wherein said container has an outer surface and the outermost extending edge of said tab is coplanar with said outer surface of said container.

3. The tamper-evident container assembly of claim 1 wherein said tab has a round outer section and a thin connecting section connecting said outer section to said threaded surface of said dispensing end of said container.

4. The tamper-evident container assembly of claim 1 wherein said cap has an inner surface and a plug disposed on said inner surface that is coextensive with, and adapted to be received within, said opening in said dispensing end of said container to prevent the contents of said container from being dispensed therefrom.

5. The tamper-evident container assembly of claim 1 wherein said container is collapsible.

6. The tamper-evident container assembly of claim 1 wherein said leading edge and trailing edge of both the container and cap threads meet at a root, and said ratcheted configuration of said threaded surface of said container includes an acute leading angle defined by said leading edge and a line perpendicular to a line through all of said roots, and an acute trailing angle defined by said trailing edge and said line perpendicular to said line through all of said roots.

7. The tamper-evident container assembly of claim 6 wherein said leading angle is between about 55° and about 65°, and said trailing angle is between about 5° and about 15°.

8. The tamper-evident container assembly of claim 6 wherein said ratcheted configuration of said threaded surface of said container includes an obtuse ratchet angle including said leading angle and said trailing angle, said ratchet angle defined by said trailing edge and said line through all of said roots.

9. A tamper-evident container assembly comprising:

a collapsible container having an outer surface and a dispensing end, said dispensing end including an opening through which the contents of said container can be dispensed, a threaded surface having a ratcheted configuration including a downwardly and outwardly sloping edge and an upwardly and outwardly sloping trailing edge, such that a threaded cap may be initially axially secured thereon but must be twisted for removal therefrom, and a frangible tab extending outwardly from said threaded surface, said tab having an enlarged outer section and a thin connecting section connecting said enlarged outer section to said threaded surface of said dispensing end of said container, with the outermost extending edge of said tab being coplanar with the outer surface of said container; and an internally threaded cap, the threads of said cap being complementary to those of said threaded surface of said dispensing end of said container with their complementary leading edges inclined at an acute angle relative to downward axial movement of said cap over said dispenser end which angle is less than an acute angle defined by their complementary trailing edges relative to axial movement of said cap over said dispenser end for preventing upward axial movement of said cap, said threads of said cap being formed prior to said cap being placed on said dispensing end of said container, said cap having a vertical notch therein extending from the lower surface thereof of a size sufficient to receive said thin connecting section of said tab with the enlarged outer section of said tab exposed so as to be readily visible, said cap being initially placed axially over said dispensing end of said container so that the thin connecting section of the said tab is received within said notch in said cap;

whereby said cap can not be initially removed from said container without separating at least said enlarged outer section of said tab from said threaded surface of said dispensing end of said container, and at least said enlarged outer section of said tab is separated from said threaded surface of said dispensing end of said container by twisting said cap with respect to said container, so that the absence of said enlarged outer section of said tab from said threaded surface of said dispensing end of said container indicates that said container has previously been opened.

10. The tamper-evident container assembly of claim 9 wherein said enlarged outer section of said tab is round.

11. The tamper-evident container assembly of claim 9 wherein said leading edge and trailing edge meet at a root, and said ratcheted configuration of said threaded surface of said container includes an acute leading angle defined by said leading edge and a line perpendicular to a line through all of said roots, and an acute trailing angle defined by said trailing edge and said line perpendicular to said line through all of said roots.

12. The tamper-evident container assembly of claim 11 wherein said leading angle is between about 55° and about 65°, and said trailing angle is between about 5° and about 15°.

13. The tamper-evident container assembly of claim 11 wherein said ratcheted configuration of said threaded surface of said container includes an obtuse ratchet angle including said leading angle and said trailing angle, said ratchet angle defined by said trailing edge and said line through all of said roots.

* * * * *